United States Patent [19]

Bouman

[11] 4,143,535

[45] Mar. 13, 1979

[54] PIPE END SHAPER

[75] Inventor: Willem J. Bouman, Toronto, Canada

[73] Assignee: Automatic Sprinkler Limited, Mississauga, Canada

[21] Appl. No.: 879,705

[22] Filed: Feb. 21, 1978

[51] Int. Cl.[2] ..... B21D 17/04

[52] U.S. Cl. ..... 72/119; 72/121; 10/95

[58] Field of Search ..... 72/118, 119, 121; 10/94, 95

[56] References Cited

U.S. PATENT DOCUMENTS

| | | | |
|---|---|---|---|
| 1,520,905 | 12/1924 | Lauren | 72/121 |
| 2,130,181 | 9/1938 | Hogg | 10/95 |
| 4,033,163 | 7/1977 | Duffey et al. | 72/121 |

*Primary Examiner*—Lowell A. Larson
*Attorney, Agent, or Firm*—Hirons & Rogers

[57] ABSTRACT

An apparatus for performing an operation upon the end of a cylindrical workpiece consists of one or more tools mounted by a frame for rotation about a mounting axis along which the workpiece is moved. Each tool is mounted for longitudinal movement along a respective tool axis inclined inwardly toward the mounting axis in the engaging direction of movement of the workpiece and is engaged by the workpiece and pushed by it along the inclined axis. The longitudinal movement of the tool is thereby accompanied automatically by movement radially inward toward the mounting axis to perform the desired operation. Preferably a plurality of tools are provided each spring urged for movement in the direction opposite to that of the workpiece, and each freely rotatable about their tools axes, so that they gyrate about the workpiece. The tools can each be provided with a radial flange that is engaged by the workpiece in its movement to move the tool. An additional central tool may be provided to cooperate with the first-mentioned tool, for example when the workpiece is a tube.

13 Claims, 5 Drawing Figures

PIPE END SHAPER

FIELD OF THE INVENTION

The present invention is concerned with improvements in apparatus for performing an operation upon the end of a workpiece, such as a rod or a tube.

REVIEW OF THE PRIOR ART

A large number of different machines have been proposed hitherto for performing operations upon a cylindrical workpiece, consisting of one or more tools that are mounted by a frame about an axis on which the workpiece is mounted and/or is moved longitudinally, the arrangement being such that relative motion is produced between the tool or tools and the workpiece permitting the tools to perform a desired operation upon the workpiece. For example U.S. Pat. No. 296,569 discloses an apparatus in which tools mounted by wings K turn a flange on the end of a pipe as they are moved forward by rotating hand wheel S, such rotation also moving the wings so as to move the tools to a progressively greater inclination to the axis until the flange has been turned completely radially. U.S. Pat. No. 1,798,074 shows apparatus in which the tools thereof are moved radially inwards on slides 20 to engage a workpiece, while U.S. Pat. No. 3,473,359 shows an example of a gyrating tool in which the tools thereof move radially inwards with longitudinal movement by means of cam slots.

DEFINITION OF THE INVENTION

It is an object of the invention to provide a new apparatus for performing an operation upon an end of a workpiece, particularly a cylindrical workpiece such as a rod or tube.

It is a more specific object to provide such an apparatus with which the operation is performed as a result of movement of the workpiece toward the apparatus by an operator.

In accordance with the invention there is provided an apparatus for performing an operation upon an end of a workpiece comprising:

means mounting a tool for rotation about a mounting axis along which the workpiece is moved in an engaging direction for engagement with the tool, said mounting means mounting the tool for longitudinal movement along a tool axis inclined toward the mounting axis in the said engaging direction of movement of the workpiece, the tool being engagable with the workpiece upon the said movement thereof in the engaging direction, and being moved along the inwardly-inclined tool axis with the workpiece, whereby the movement of the workpiece in the engaging direction is accompanied by movement of the tool toward the mounting axis to engage it with the workpiece for it to perform an operation thereon.

DESCRIPTION OF THE DRAWINGS

Apparatus which are particular preferred embodiments of the invention will now be described, by way of example, with reference to the accompanying drawings, wherein.

The same reference numbers are used for similar parts in all the figures of the drawing.

DESCRIPTION OF THE PREFERRED EMBODIMENTS

Figure 4:
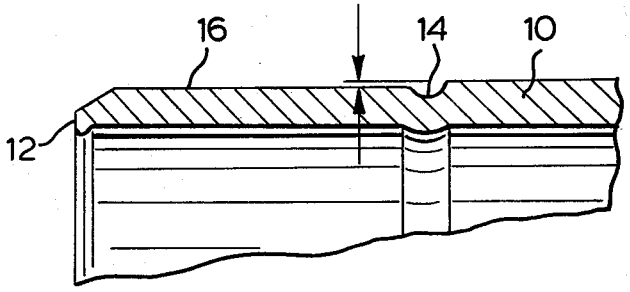
FIG. 4 is a longitudinal cross-section through a part of a side wall of a workpiece to show the profile formed therein.

The particular embodiments described herein are intended for operation with a thin-walled hollow tubular workpiece 10, in the end of which it is required to form a profile as shown in detail in FIG. 4. With this particular profile the extreme end 12 of the tube is turned radially inward, while a circular groove 14 is formed spaced along the tube from its end for the reception of a circlip (not shown), by which a pipe fitting (also not shown) may be secured to the tubular workpiece. The part 16 of the tube 10 between the end 12 and the groove 14 is of reduced external diameter as compared to the rest of the tube to facilitate reception of the pipe fitting thereon.

The apparatus consists of a rear baseplate 18 from the back surface of which extends an internally screw-threaded boss 20 by which the apparatus is mounted for rotation about longitudinal mounting axis 22. The machine by which the apparatus is rotated provides an externally-threaded quill 23 inserted in the boss 20; construction of the machine for mounting and rotating the apparatus will be apparent to those skilled in the art and forms no part of the present invention, so that further description thereof is not believed necessary. A front plate 24 parallel to the rear plate 18 is spaced therefrom by three radially-extending tool support members 26, the plates 18 and 24 and the support members 26 being held together to form a unitary assembly by through bolts 28 and nuts 30. Each support member 26 has one end inserted in a radial groove 32 in the plate 18 and is fastened therein by a bolt 34, so that it will remain in position even if the front plate is removed. The bolt 34 permits radial movement of the respective support member 26 to accomodate for differences in diameter of workpiece 10.

Each support member 26 carries a respective forming tool 36, which is mounted on a shaft 38 for rotation about a longitudinal tool axis 40, and also for longitudinal movement along that axis. Each shaft 38 has its front end mounted in a corresponding bore 42, while its rear end is mounted in a bushing 44 in an enlarged bore 46, thereby providing an annular chamber that accomodates a compression spring 48 mounted around the shaft 38 and urging the tool 36 forward along the shaft.

Figure 1:
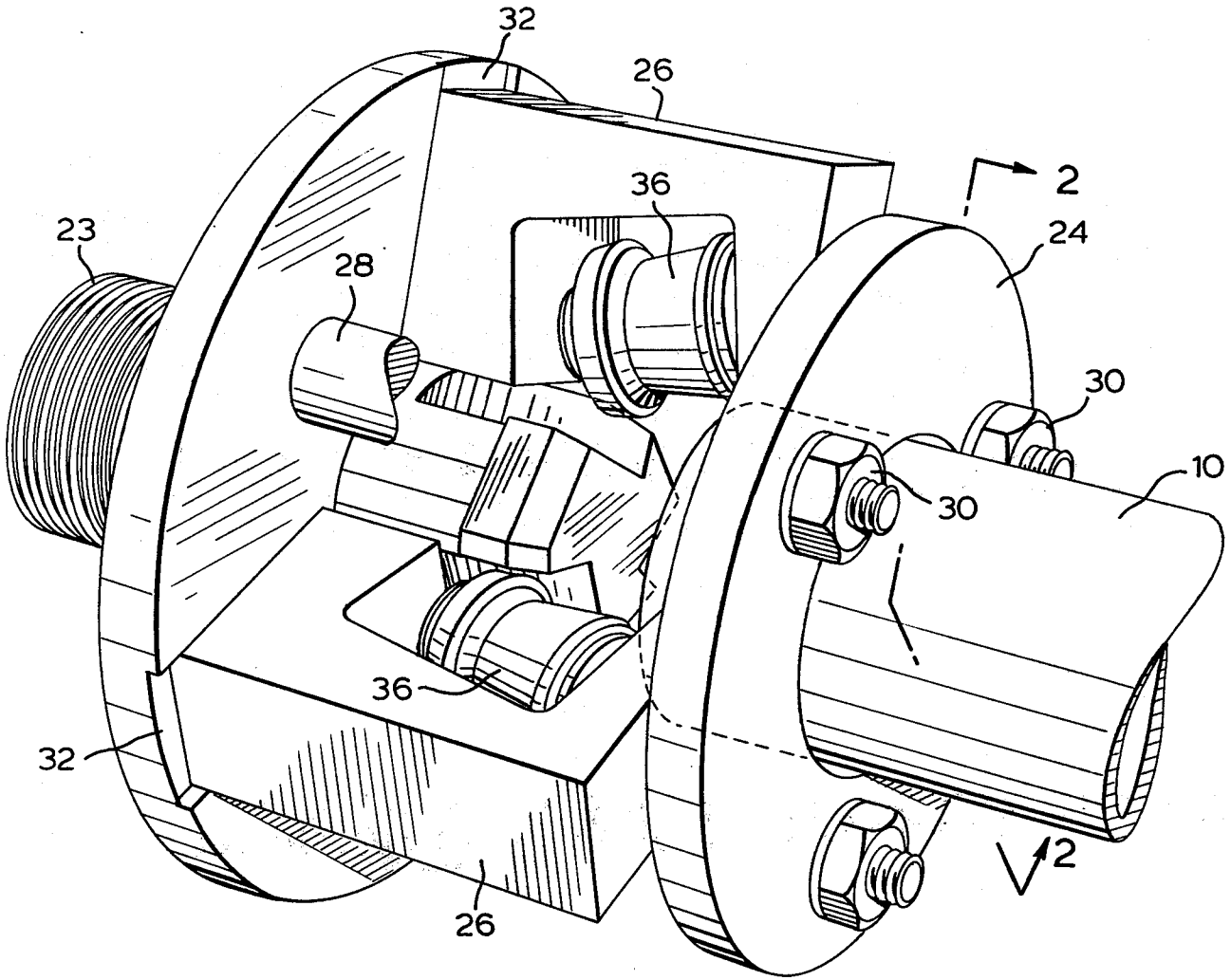
FIG. 1 is a perspective view of the apparatus with a tubular workpiece in position for operation thereon.
Figure 2:
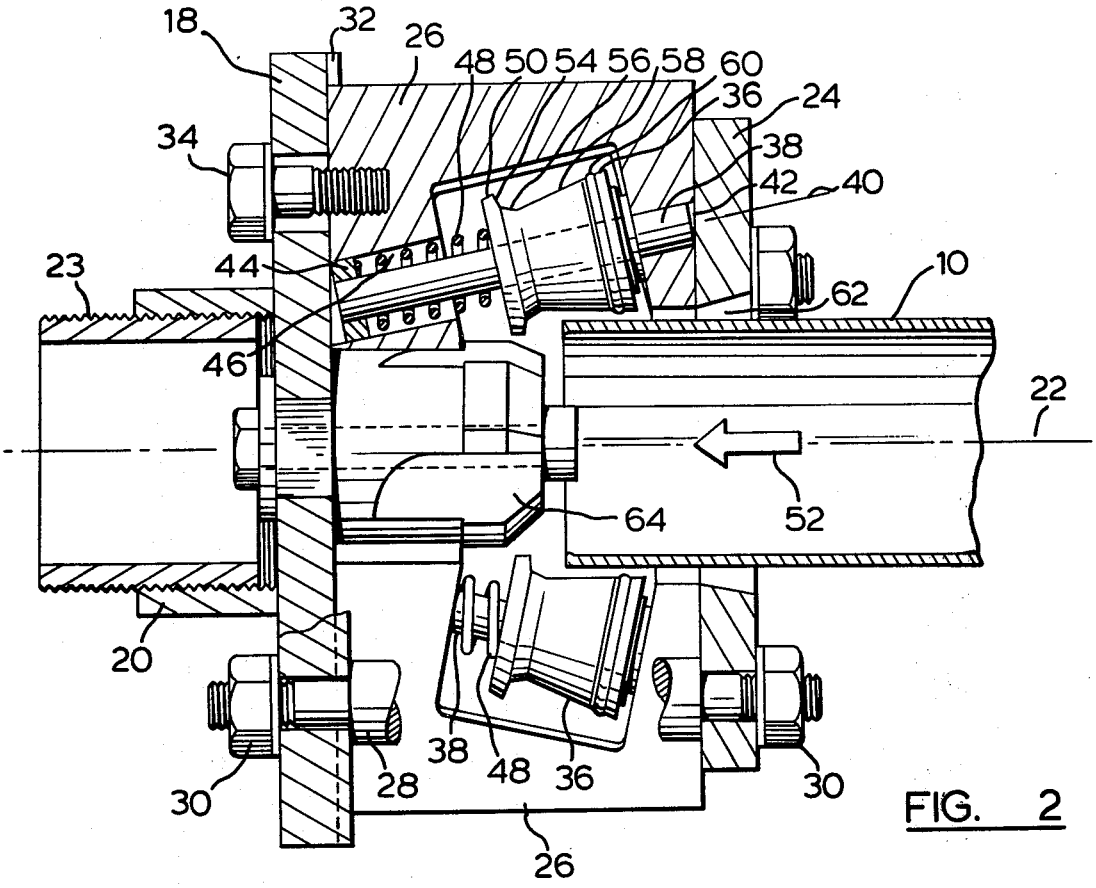
FIG. 2 is a section on the line 2—2 of FIG. 1.
Figure 3:
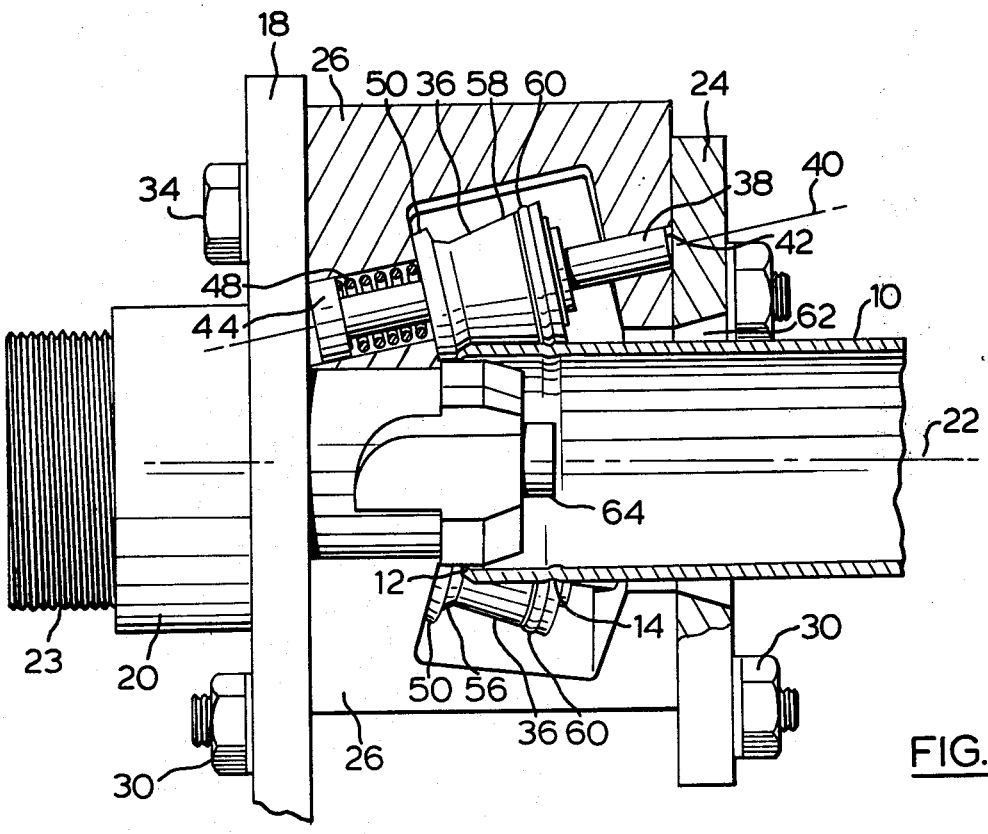
FIG. 3 is a similar section to FIG. 2, showing the workpiece fully inserted into the apparatus and ready for withdrawal.
Figure 5:
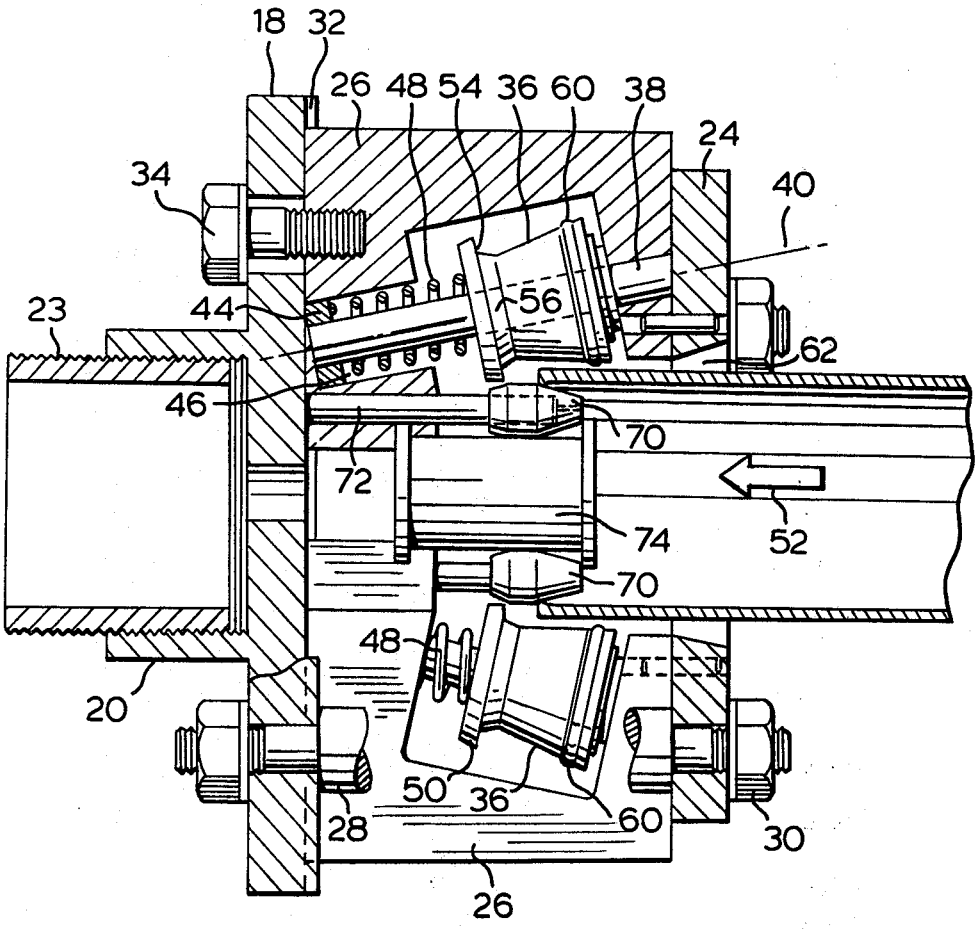
FIG. 5 is a section similar to FIG. 2 in an apparatus in which the central cutter is replaced by central rollers.

The axes 40 are inclined symetrically inwards toward the central axis 22, so that rearward movement of the tools 36 is accompanied by simultaneous radially-inward movement thereof for engagement with the workpiece. Each tool 36 provides a rearmost radially-outwardly-extending flange 50 which, in the extreme forward position of the tool, (as shown in FIG. 2) is engagable by the workpiece 10 as the latter is moved in the direction of the arrow 52, so that further rearward movement of the workpiece is accompanied by corresponding movement of the tool. The tool surfaces 54 and 56 immediately adjacent the flange 50 are shaped to form the desired profile on the end 12 of the workpiece when the tool is in its extreme rearward position, as shown in FIG. 3, while the tool surface 58 immediately adjacent the surface 56 is shaped to provide the cylindrical portion 16 of reduced external diameter. The groove 14 is formed by a corresponding circular ridge 60 of the required profile.

Thus, the apparatus of the invention is rotated at an appropriate speed while the tubular workpiece 10 is inserted through an inwardly tapered aperture 62 in the front plate 24, either by hand by an operator, or by some suitable loading machine. As the tubular workpiece moves in the direction of the arrow 52 the end 12 engages the tool flanges 50 and moves the tools rearwards against the urge of the springs 48. Since the tools are able to rotate freely on their shafts 38, their engagement with the workpiece causes them to rotate about the respective axes 40 and to gyrate about the axis 22, so that they are operative to perform a rolling operation upon the end of the workpiece as they are moved radially inward with their rearward movement. The profile of the tools and the arrangement of the apparatus is such that, when the workpiece reaches the end of its travel with the tools at their rearward position, as shown in FIG. 3, the desired profile has been rolled in the end of the workpiece.

In this particular embodiment it is required that the inside of the tubular workpiece be free of projections, etc. formed by the exterior rolling, and to this end there is provided a central cylindrical cutter 64 mounted on the rear plate 18 so as to protrude into the interior of the workpiece, the cutter being shaped to perform the desired cutting operation on the interior surface thereof, and having cut-away portions which the tools can enter in their rearward position.

The apparatus of FIG. 3 employs a rolling tool to perform the internal operation on the hollow tubular workpiece, consisting of a plurality of rollers 70, each mounted for free rotation on a respective shaft 72, and supported for the rolling operation by a central back-up roller 74 coaxial with the axis 22. Although in the first embodiment the tools 36 perform only a rolling operation it will be apparent to those skilled in the art that they can alternatively perform other types of metal deformation operation bearing in mind that there is no tangential motion between the tools 36 and the workpiece 10, since they move together into the apparatus.

I claim:

1. Apparatus for performing an operation upon an end of a workpiece comprising:

means mounting a tool for rotation about a mounting axis along which the workpiece is moved in an engaging direction for engagement with the tool, said mounting means mounting the tool for longitudinal movement along a tool axis inclined toward the mounting axis in the said engaging direction of movement of the workpiece, the tool being engagable with the workpiece upon the said movement thereof in the engaging direction, and being moved along the inwardly-inclined tool axis with the workpiece, whereby the movement of the workpiece in the engaging direction is accompanied by movement of the tool toward the mounting axis to engage it with the workpiece for it to perform an operation thereon.

2. Apparatus as claimed in claim 1, and comprising means mounting a plurality of similar tools for rotation about the said mounting axis, each tool being mounted for longitudinal movement along a respective tool axis inclined toward the mounting axis in the said engaging direction of movement of the workpiece.

3. Apparatus as claimed in claim 1, wherein the said tool is mounted for free rotation about the said tool axis, so that it moves with a gyrating motion upon rotation about the mounting axis.

4. Apparatus as claimed in claim 2, wherein each said tool is mounted for free rotation about the respective tool axis, so that they move with respective gyrating motions upon rotation about the mounting axis.

5. Apparatus as claimed in claim 1, and comprising a spring mounted about the said tool axis between the tool and the mounting means and urging the tool in the direction opposite to said engaging direction.

6. Apparatus as claimed in claim 2, and comprising for each tool a respective spring mounted about the respective tool axis between the tool and the mounting means and urging the tool in the direction opposite to the said engaging direction.

7. Apparatus as claimed in claim 3, wherein the tool is a roller and performs a rolling operation on the end of the workpiece.

8. Apparatus as claimed in claim 4, wherein each tool is a roller and performs a respective rolling operation on the end of the workpiece.

9. Apparatus as claimed in claim 3, wherein each tool has a radially-outwardly extending flange thereon that is engaged by the workpiece in the said engaging direction of movement to move the respective tool along the tool axis.

10. Apparatus as claimed in claim 1, and including an additional tool mounted on the said mounting axis for performing an operation upon the end of the workpiece together with the first mentioned tool upon movement of the workpiece in the said engaging direction.

11. Apparatus as claimed in claim 2, and including an additional tool mounted on the said mounting axis for performing an operation upon the end of the workpiece together with the first mentioned tools upon movement of the workpiece in the said engaging direction.

12. Apparatus as claimed in claim 11, wherein the said additional tool is a cutter performing a cutting operation on the workpiece.

13. Apparatus as claimed in claim 11, wherein the said additional tool is a plurality of rollers performing a rolling operation on the workpiece.

* * * * *